United States Patent [19]

Schauer

[11] 4,121,502

[45] Oct. 24, 1978

[54] HYDRAULIC UNIT AND TRANSFER TUBE AND SEAL STRUCTURE THEREFOR

[75] Inventor: George A. Schauer, Ames, Iowa

[73] Assignee: Sundstrand Corporation, Rockford, Ill.

[21] Appl. No.: 778,368

[22] Filed: Mar. 17, 1977

[51] Int. Cl.[2] ..... F01B 13/04

[52] U.S. Cl. ..... 91/487

[58] Field of Search ..... 285/95, 347, 370; 277/27, 177; 91/487, 491

[56] References Cited

U.S. PATENT DOCUMENTS

| | | | |
|---|---|---|---|
| 1,691,518 | 11/1928 | Hall | 277/27 |
| 2,325,469 | 8/1943 | Boissou | 285/347 |
| 2,809,853 | 10/1957 | Nathan | 285/347 |
| 3,075,778 | 1/1963 | Bowers et al. | 277/27 |
| 3,136,263 | 6/1964 | Timms | 91/487 |
| 3,150,889 | 9/1964 | Watts | 285/347 |
| 3,887,198 | 6/1975 | McClure | 277/27 |

FOREIGN PATENT DOCUMENTS

| | | | |
|---|---|---|---|
| 2,123,429 | 11/1971 | Fed. Rep. of Germany | 91/487 |
| 233,429 | 7/1944 | Switzerland | 277/27 |
| 887,583 | 1/1972 | United Kingdom | 91/499 |

*Primary Examiner*—William L. Freeh

*Attorney, Agent, or Firm*—Wegner, Stellman, McCord, Wiles & Wood

[57] ABSTRACT

A transfer tube and seal structure for a hydraulic unit for connecting a pair of flow passages in a housing to flow passages in a valve plate which is floatingly mounted and engageable against a cylinder block in an axial piston hydraulic unit with ports in the valve plate communicating with axially-extending bores in the cylinder block, each of which carries a piston movably mounted therein. A transfer tube is loosely positioned in coaxial flow passages to span the gap between the valve plate and the housing and maintain a sealed flow relation therebetween while permitting movement of the valve plate relative to the housing. The transfer tubes each have an outwardly-opening groove adjacent each end thereof mounting a metallic seal ring and with the outer face of the seal ring being of substantially reduced width for a limited area of sealing contact with the walls of the flow passages.

10 Claims, 2 Drawing Figures

HYDRAULIC UNIT AND TRANSFER TUBE AND SEAL STRUCTURE THEREFOR

BACKGROUND OF THE INVENTION

This invention pertains to a transfer tube and seal structure for use in hydraulic devices and, more particularly, to use of such structure in a hydraulic unit for connecting flow passages between a housing of a pump or motor and a floating valve plate which conducts flow to and from a cylinder block movably mounting a plurality of pistons.

The use of transfer tubes in hydraulic units is generally known in the art, as shown in U.S. Pat. Nos. 3,059,432, 3,136,263, 2,273,468, and 3,808,950. Several of these patents show the use of seal rings for sealing the transfer tube to the walls of the flow passages which are connected by the transfer tubes. The prior art has not shown a transfer tube and seal ring structure particularly suitable for use with a floating valve plate which adjusts its position during operation and which requires minimal force in assembly and provides less resistance to movement of the valve plate because of less outward force imposed by the seal rings.

SUMMARY OF THE INVENTION

A primary feature of the invention is to provide a transfer tube and seal structure with the seal member having a reduced width outer face, as by tapering thereof, to remove a major part of the sealing force exerted by the seal ring and to also permit easy assembly of the transfer tube and seal structure within the flow passages.

In carrying out the foregoing feature of the invention, the transfer tube is placed within the flow passages of a valve plate and an adjacent member and has an outwardly-opening peripheral groove receiving a seal ring having a width extending lengthwise of the transfer tube and with the outer face of the seal ring having a minor part of the width thereof of a full diameter to engage the wall of the flow passage and with the remainder of the outer face being of a lesser diameter to be out of contact with the flow passage wall whereby only a small part of the outer face is in frictional engagement with the flow passage wall during insertion of the transfer tube and seal ring and the effect of fluid pressure acting to force the seal ring out against the wall of the flow passage is reduced.

An object of the invention is to provide a transfer tube and seal structure for a hydraulic unit having a floating valve plate including use of transfer tubes to connect flow passages in the valve plate to flow passages in an adjacent housing and with each transfer tube being of a diameter to loosely fit in the flow passages and with a pair of outwardly-opening peripheral grooves in the transfer tubes with one groove adjacent each end thereof and an annular seal member of metallic material positioned in each groove to have a full diameter section of limited width for engagement with the wall of a flow passage and a major part of the outer face tapered inwardly toward the base of the groove and an end of the transfer tube to reduce the area of engagement of the seal ring with the wall of the passage and the sealing force applied to the seal member.

Still another object of the invention is to provide a structure as defined in the preceding paragraph wherein the seal member is a ring of metallic structure and with the ring being split to facilitate placement in the groove over a reduced diameter section at the end of the transfer tube and with the adjacent ends of the flow passages being chamfered to act against the tapered part of the outer face of the seal rings to facilitate manual insertion of the end of the transfer tube in a flow passage.

DESCRIPTION OF THE PREFERRED EMBODIMENT

Figure 1:
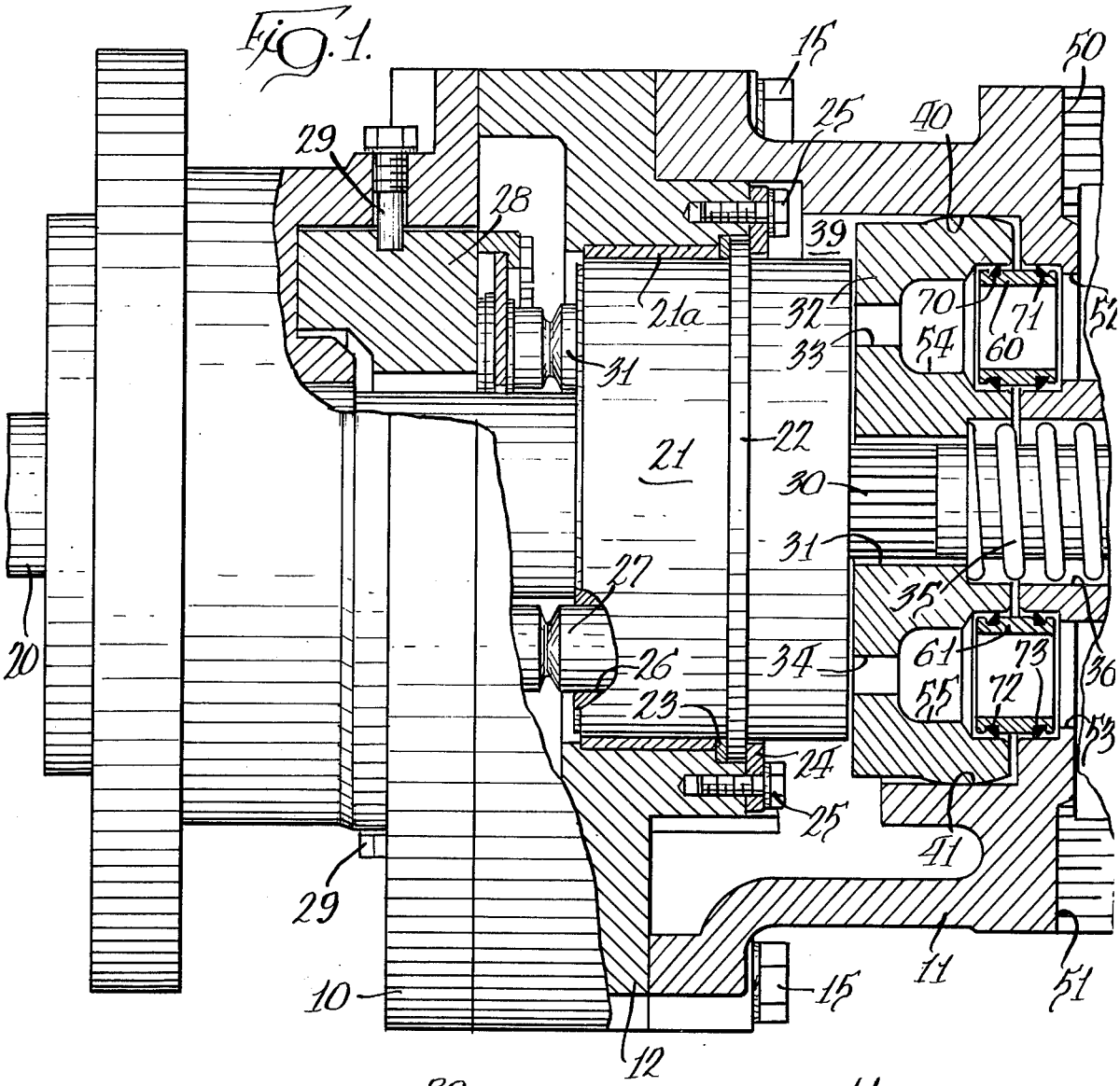
FIG. 1 is an elevational view of a hydraulic unit embodying the transfer tube and seal ring structure, with a part of the casing and a cylinder block broken away.

The hydraulic unit has a casing, or housing, including end sections 10 and 11 and an intermediate section 12 which are held in assembled relation by threaded attaching members 15, with the end section 10 rotatably mounting a shaft 20 which extends out from the end thereof and has a cylinder block 21 affixed thereto within the housing. The cylinder block 21 is rotatably positioned within a cavity in the housing by a bearing sleeve **21*a* and has an axial thrust journal 22 captured between a pair of annular members 23 and 24 held in assembled relation to the intermediate housing member 12 by threaded members 25. The cylinder block 21 has a series of axially-extending bores 26, each of which movably mounts a piston 27 which, as shown, are in a zero stroke position. The pistons are controlled by a swash plate 28 which is pivotally mounted on a pair of opposed coaxial pivot pins 29 for movement to various inclined positions for placing the pistons 27** in stroke, as is well known in an axial piston unit which may function as either a pump or a motor.

A shaft 30 splined to an interior opening in the cylinder block 21 extends out through the housing end section 11 and loosely through a larger diameter opening 31 in a floating valve plate 32 having a pair of ports 33 and 34 for successively communicating with the axially-extending bores 26 in the cylinder block 21 during rotation of the cylinder block. The floating valve plate 32 is urged into face engagement with the adjacent face of the cylinder block by a spring 35 surrounding the shaft 30 and abutting at opposite ends against an end (not shown) of a bore 36 in the housing end section 11 and the floating valve plate. Additionally, the valve plate is provided with balance motor structure operable by fluid pressure to urge the valve plate toward the cylinder block. For clarity, this structure has not been shown and reference may be made to a copending application of the applicant, Ser. No. 755,186, filed Dec. 29, 1976 for a complete description of such structure and the disclosure thereof is incorporated herein by reference.

As seen in FIG. 1, the foating valve plate 32 is of a diameter less than a recess 39 formed in the housing end section 11 for mounting thereof and with enlargements 40 and 41 formed on the periphery of the floating valve plate to facilitate movement, including inclination thereof, to remain in face contact with the cylinder block 21.

The housing end section 11 has a pair of ports 50 and 51 which communicate with a pair of flow passages 52 and 53 with enlarged sections, respectively, which are coaxial with a pair of flow passages 54 and 55 in the floating valve plate which communicate with the ports 33 and 34, respectively. The flow passages 54 and 55 have enlarged sections of the same diameter as the enlarged sections of flow passages 52 and 53.

A pair of cylindrical transfer tubes 60 and 61 is positioned in the enlarged sections of the flow passages to form a closed flow path between the housing port 51 and the valve plate port 34 and the housing port 50 and the valve plate port 33 and, as shown, span a gap between adjacent faces of the valve plate and the housing end section 11. Transfer tubes 60 and 61 have an external diameter less than the diameter of enlarged sections of the flow passages 52 and 53 in the housing end section and of the valve plate flow passages 54 and 55 whereby the transfer tubes permit shift of the valve plate relative to the housing end section.

Figure 2:
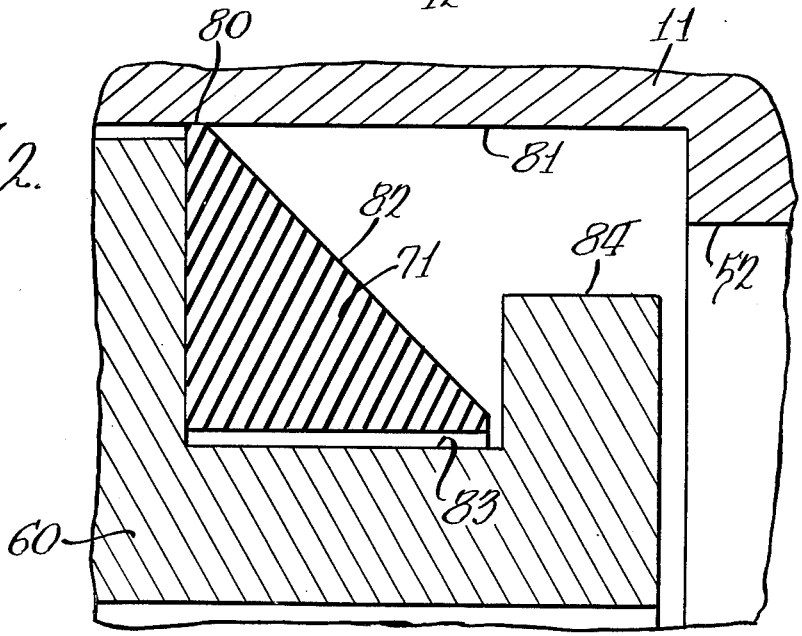
FIG. 2 is a partial section, on an enlarged scale, showing the coaction between a transfer tube, a seal ring, and the wall of a flow passage.

Annular seal members, in the form of split metallic seal rings, are associated with each of the transfer tubes for preventing fluid flow into the gap between the valve plate and the housing end section 11. The transfer tube 60 has the seal rings 70 and 71 and the transfer tube 61 has the seal rings 72 and 73. The sectional view of FIG. 2 shows a part of the transfer tube 60 and the seal ring 71 in association with the enlarged section of the flow passage 52 on an enlarged scale. The seal ring 71 has a generally triangular cross-section with a width extending lengthwise of the transfer tube 60 whereby a full diameter minor part 80 of the outer face of the seal ring is in sealing engagement with a wall 81 of the flow passage and the major part 82 of the seal ring outer face is set back from the wall 81. This setback is provided by a major part 82 of the outer face tapering inwardly toward the end of the transfer tube and toward the base of an outwardly opening mounting groove 83 for the seal ring which extends circumferentially around the transfer tube adjacent the end thereof. The ring 71 is split to facilitate its placement within the groove 83 of the transfer tube and this placement is facilitated by a reduced diameter end 84 of the transfer tube. The seal ring is of a size whereby it is under compression when positioned in the flow passage 52 and as shown in FIG. 2. The structure of the seal ring results in the minor part 80 of the outer face being a minor part of the seal ring width engaging the wall 81 whereby the transfer tube and seal ring may be easily moved into a flow passage with minimal friction and without the use of special tools. The end of a flow passage may optionally have a slight chamfer, as shown, to coact with the taper of the outer face major part 82 and compress the seal ring sufficiently to permit insertion thereof in the flow passage. During operation, the sealing forces are minimized because of the limited engagement and also because high pressure fluid reaching the space between the base of the groove 83 and the inner diameter of the seal ring acts primarily on an area equal to the minor part 80 of the outer face since the remainder of the seal ring width has high pressure fluid also acting on the tapered major part 82 of the outer face.

Again referring to FIG. 1, it will be noted that the other seal ring 70 for the transfer tube 60 has the tapered major part of the outer face facing the adjacent end of the transfer tube for easy insertion into the enlarged section of the flow passage 54 of the valve plate. The transfer tube 61 has the seal ring 73 with the major part of the outer face extending toward the end of the transfer tube inserted into the flow passage 53 while the seal ring 72 has the major part of the outer face extending toward the adjacent end of the transfer tube for easy insertion into the flow passage 55 of the valve plate.

The reduction in width of the outer face of the seal ring provides less peripheral surface and, thus, less frictional resistance to initial positioning of the transfer tube and seal ring into a flow passage and also results in a lesser outward force applied by the seal ring against the wall of the flow passage while still maintaining an effective fluid seal.

I claim:

1. A transfer tube and seal structure for use in hydraulic devices comprising, a transfer tube with a central flow passage and at least one outwardly opening groove extending circumferentially therearound, a seal member of generally triangular cross-section surrounding said tube and positioned in said groove and having a width to provide an inner face extending along a base of said groove, and an outer face with a small section of the member width providing a seal area and a major section of the outer face tapering from the seal area toward said inner face.

2. A transfer tube and seal structure wherein said seal is annular and of metal.

3. A transfer tube and seal structure as defined in claim 2 wherein said transfer tube is cylindrical and has a pair of said grooves spaced apart lengthwise of said tube, and one of said seal members positioned in each groove with the tapered major sections of the outer faces facing toward the respective ends of said tube.

4. A transfer tube and seal structure as defined in claim 3 wherein said grooves are adjacent the ends of said tube and the ends of said tube are of a reduced diameter.

5. A hydraulic unit having a housing, a rotatable cylinder block mounted in said housing, and a floating plate abutting said block with a flow passage in said plate for transmitting fluid flow between a housing flow passage and the block, the improvement comprising; a generally cylindrical transfer tube loosely positioned in both the plate and housing flow passages and having a groove extending circumferentially therearound, and a metallic seal ring surrounding said transfer tube and captured against movement longitudinally thereof, the full width of the seal ring being received in said groove, said seal ring having an outer face having a full diameter section for engagement with the wall of the flow passage with a part thereof tapered and extending from said full diameter section toward a bottom of said groove to provide a limited surface contact between the outer face of the seal ring and the surrounding flow passage.

6. A hydraulic unit as defined in claim 5 wherein said transfer tube has a pair of said grooves adjacent opposite ends thereof and a pair of said seal rings positioned one in each groove and with said tapered part facing toward the adjacent end of the tube.

7. A hydraulic unit of the axial piston type including a housing, a cylinder block rotatably mounted in said housing and having a series of axially extending open-ended bores, a plurality of pistons movably mounted one in each of said bores, a valve plate loosely mounted in said housing and positioned to be in sealed relation with said cylinder block and having ports for directing the flow of fluid to and from said bores as said cylinder block rotates, a pair of generally coaxial flow passages in each of said valve plate and said housing communicating with said ports, a pair of transfer tubes loosely positioned one in each set of coaxial flow passages to form a closed flow path from the housing to a port, a pair of outwardly opening grooves extending around each transfer tube adjacent opposite ends thereof, a metallic split seal ring positioned in each of said transfer tube grooves and having a diameter slightly greater than the diameter of said flow passages to be under compression, and each seal ring having a generally triangular cross-section with a width dimension lengthwise of the transfer tube and with an outer face of each seal ring having a minor part thereof of full diameter to seal against a wall of said flow passages and the remainder of the outer face being of a lesser diameter to be spaced from said flow passage wall.

8. A hydraulic unit as defined in claim 7 wherein each of said seal rings has the outer face inwardly tapered from said minor part toward an end of the transfer tube.

9. A hydraulic unit as defined in claim 8 wherein adjacent ends of the flow passages in the valve plate and the housing are chamfered to cam said seal rings inwardly upon assembly of the transfer tubes and seal rings into said flow passages.

10. A hydraulic unit as defined in claim 9 wherein the ends of said transfer tubes are of a reduced diameter to facilitate insertion of the seal rings in said grooves.

* * * * *